US007341566B2

(12) United States Patent
Nan

(10) Patent No.: US 7,341,566 B2
(45) **Date of Patent: *Mar. 11, 2008**

(54) MASSAGE APPARATUS WITH CONTROL PANEL

(75) Inventor: Simon Siu Man Nan, Richmond Hill (CA)

(73) Assignee: Nanma Manufacturing Co., Ltd., Chai Wan (HK)

( * ) Notice: Subject to any disclaimer, the term of this patent is extended or adjusted under 35 U.S.C. 154(b) by 0 days.

This patent is subject to a terminal disclaimer.

(21) Appl. No.: 11/268,973

(22) Filed: Nov. 8, 2005

(65) Prior Publication Data

US 2006/0069330 A1 Mar. 30, 2006

Related U.S. Application Data

(63) Continuation-in-part of application No. 10/950,935, filed on Sep. 27, 2004.

(51) Int. Cl.
*A61H 1/00* (2006.01)
*A61H 23/02* (2006.01)

(52) U.S. Cl. ..... 601/72; 601/70; 601/80

(58) Field of Classification Search ..... 601/46, 601/67, 69, 70, 72, 73, 78, 80; 600/38; 429/96, 98, 100, 178
See application file for complete search history.

(56) References Cited

U.S. PATENT DOCUMENTS 2,963,598 A 12/1960 Kent
3,779,238 A 12/1973 Cutler et al.
3,978,851 A 9/1976 Sobel
4,414,963 A 11/1983 Kunz
4,729,368 A * 3/1988 Guitay ..... 601/123
4,777,940 A 10/1988 Yamasaki
4,790,296 A 12/1988 Segal
5,063,911 A 11/1991 Teranishi
5,067,480 A 11/1991 Woog et al.
5,123,406 A 6/1992 Masuda
5,183,034 A 2/1993 Yamasaki et al.
5,460,597 A 10/1995 Hopper
5,470,303 A 11/1995 Leonard et al.
5,521,022 A 5/1996 Petzl
5,823,844 A 10/1998 Markowitz
6,037,078 A 3/2000 Siu-Man
6,083,180 A 7/2000 Shimizu
6,183,428 B1 2/2001 Kilgore
6,190,307 B1 2/2001 Tsai
6,280,403 B1 * 8/2001 Lok ..... 601/70
6,432,072 B1 * 8/2002 Harris et al. ..... 601/108
6,632,185 B2 * 10/2003 Chen ..... 601/101
6,730,051 B2 5/2004 Lin (Continued)

*Primary Examiner*—Quang D. Thanh
(74) *Attorney, Agent, or Firm*—Christopher R. Carroll; Peter S. Gilster; Greensfelder, Hemker & Gale, P.C.

(57) ABSTRACT

A massage apparatus with a removable battery compartment having a control panel for controlling the operation of the apparatus is disclosed. The massage apparatus comprises a main body operatively engaged to at least one massage actuator for providing a massage function. The main body is adapted to be operatively engaged to the removable battery compartment for providing power and control function to the at least one massage actuator. Once the removable battery compartment is operatively engaged to the main body, the control panel becomes operational and allows a user to control the operation of the massage apparatus when the removable battery compartment is operatively engaged to the main body.

12 Claims, 3 Drawing Sheets

U.S. PATENT DOCUMENTS

2003/0009116 A1 1/2003 Luettgen et al.
2003/0120185 A1 6/2003 Dirks et al.
2003/0220593 A1 11/2003 Morton
2004/0068213 A1* 4/2004 Fujisawa ..... 601/70

* cited by examiner

MASSAGE APPARATUS WITH CONTROL PANEL

CROSS REFERENCE TO RELATED APPLICATIONS

This application is a Continuation-In-Part that claims benefit of U.S. patent application Ser. No. 10/950,935, filed Sep. 27, 2004 and is herein incorporated by reference in its entirety.

FIELD

The present document relates to a battery powered massage apparatus with a control panel.

SUMMARY

According to one embodiment, the massage apparatus comprises a main body, the main body including at least one massage actuator; and a removable battery compartment adapted to be operatively engaged to the main body, the removable battery compartment including a control panel for operating the at least one massage actuator.

According to another embodiment, the massage apparatus comprises a main body, the main body being operatively associated with at least one massage actuator, and a removable battery compartment adapted to be operatively engaged to the main body, the removable battery compartment including a control panel for controlling operation of the at least one massage actuator when the removable battery compartment is operatively engaged to the main body.

In yet another embodiment, the waterproof massage apparatus comprises a main body having at least one massage actuator, the main body being adapted to be operatively engageable with a removable battery compartment, the removable battery compartment including sealing elements for providing a water-tight seal between the main body and said removable battery compartment when the removable battery compartment is operatively engaged to the main body, the removable battery compartment having a control panel for controlling operation of the at least one massage actuator.

In another embodiment, the removable battery compartment adapted to be engaged to a main body of a massage apparatus comprising a body, said body defining a plurality of compartments, each of said plurality of compartments adapted to receive a battery therein, and a terminal end member operatively engaged to a control panel, the control panel being adapted to control the operation of the massage apparatus when the removable battery compartment is operatively engaged to the main body of the massage apparatus.

Implementations of the above embodiments may include one or more of the following features:

The removable battery compartment includes a terminal end member having the control panel located on the terminal end member.

The main body further includes a motor in operative association with the at least one massage actuator with the control panel having a switch arrangement to control the operation of said at least one massage actuator.

The control panel includes a waterproof faceplate.

The removable battery compartment further comprises at least one sealing member that forms a water-tight seal with the main body when the removable battery compartment is operatively engaged to the main body. The at least one massage actuator is a squirming massage actuator.

The control panel includes at least one indentation and at least one pushbutton disposed beneath the at least one indentation, wherein at least one pushbutton operatively controls the operation of the at least one massage actuator.

The control panel further includes a second pushbutton disposed beneath a second indentation, the second pushbutton being adapted to change the rotational movement of said at least one massage actuator from a clockwise motion to a counterclockwise motion and vice-versa.

The control panel further includes a third pushbutton disposed in a third indentation, said third pushbutton being adapted to adjust a vibrating action produced by said at least one massage actuator from a "low" mode to a "high" mode.

The control panel is made operational when the removable battery compartment is engaged to the main body.

The control panel becomes operatively associated with the at least one massage actuator when the removable battery compartment is engaged to the main body.

The at least one massage actuator is a vibration massage actuator.

Additional features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings.

DETAILED DESCRIPTION

Figure 1:
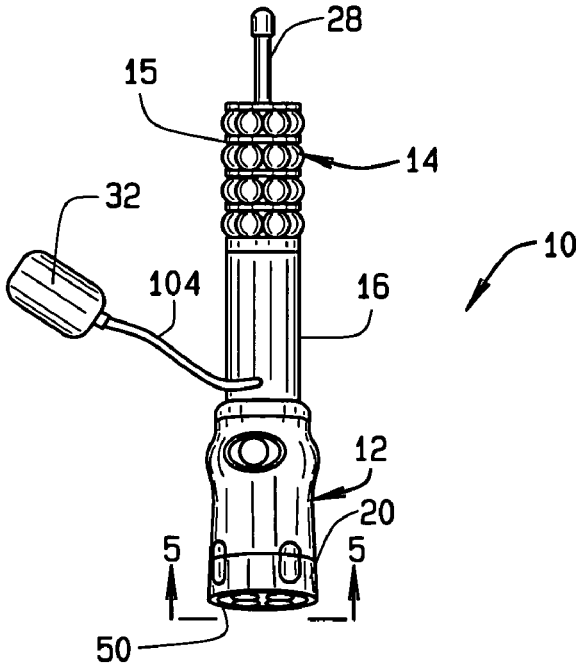
FIG. 1 is an orthogonal view of the massage apparatus.
Figure 5:
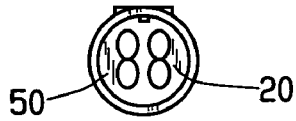
FIG. 5 is an end view of the massage apparatus taken along line 5-5 of FIG. 1.
Figure 4:
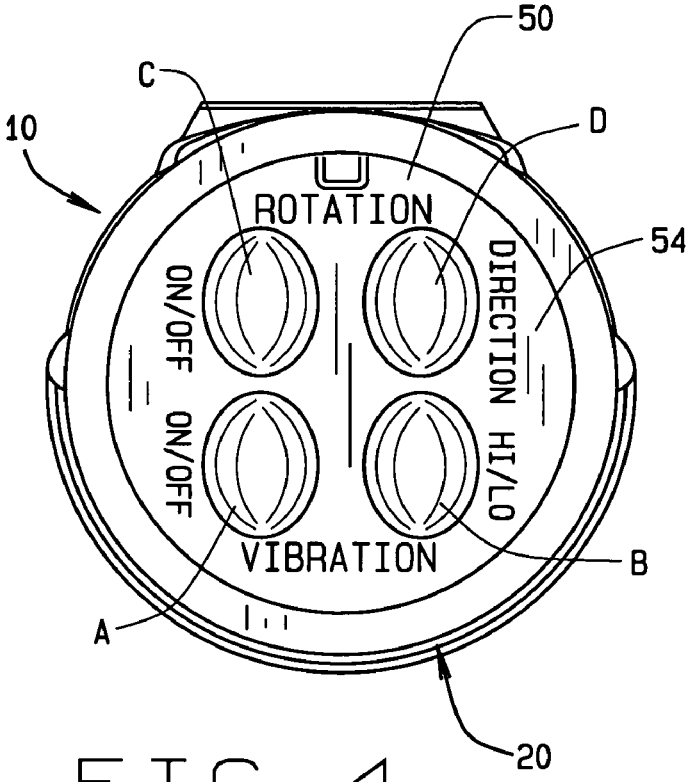
FIG. 4 is an end view of an embodiment of the control panel for the massage apparatus.

Referring to the drawings, an embodiment of the massage apparatus is illustrated and generally indicated as 10 in FIGS. 1-5. The massage apparatus 10 comprises a main body 12 defining a chamber 72 in communication with an open end 70 adapted to receive a removable battery compartment 18 having a plurality of batteries 26 for supplying power to one or more massage actuators, such as vibration massage actuator 22 and squirming massage actuator 14, operatively engaged to main body 12. As further shown, the removable battery compartment 18 has a terminal end member 50 having a control panel 20 for operating the massage apparatus 10 once the removable battery compartment 18 is operatively engaged to the main body 12 as shall be discussed in greater detail below.

Figure 2:
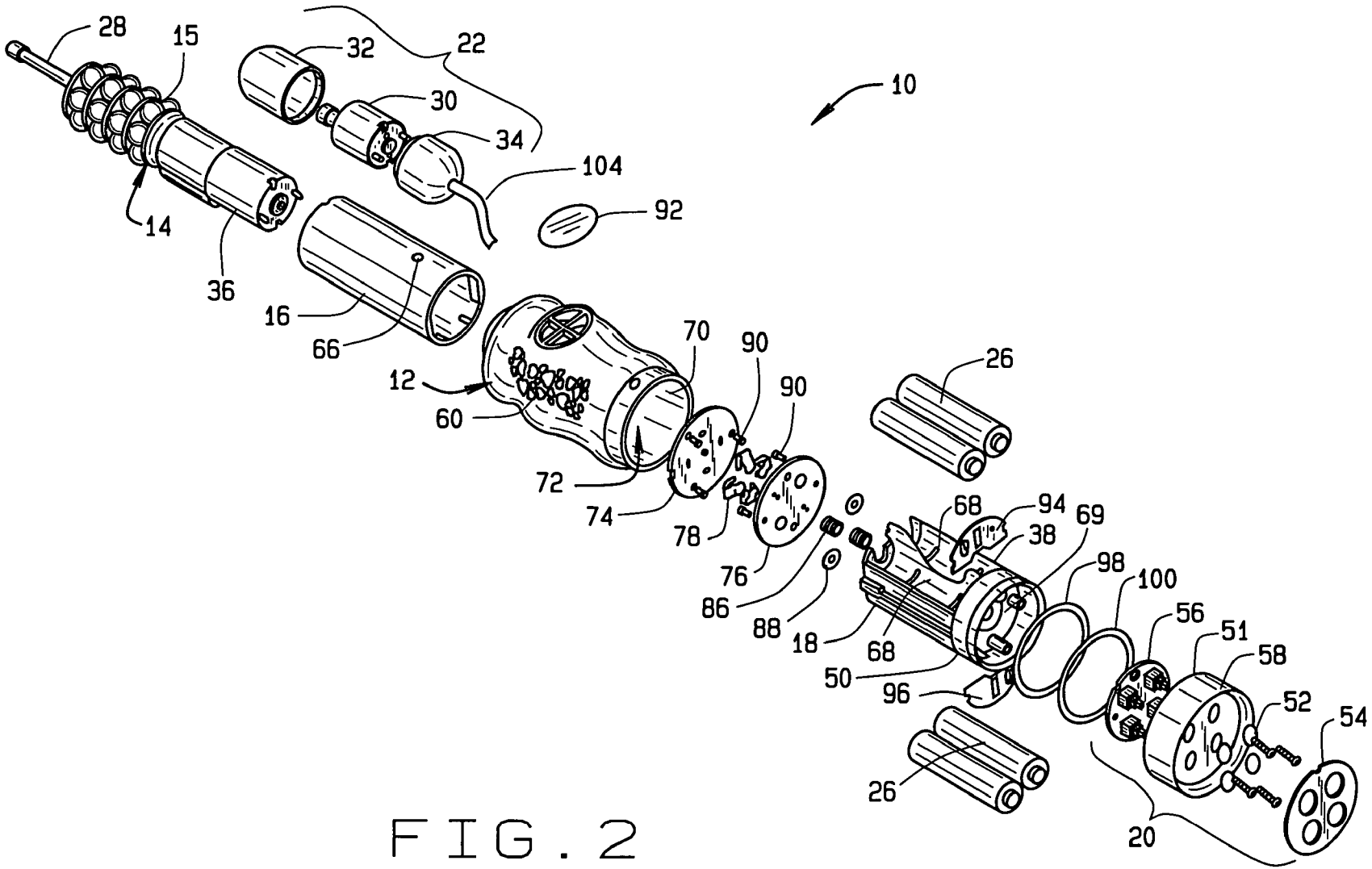
FIG. 2 is an isometric exploded view of the massage apparatus.

Referring to FIG. 2, a hollow cylindrical member 16 is engaged to main body 12 for encasing a portion of the squirming massage actuator 14 comprising a motor 36 that is in operative engagement with a gear case assembly 15 for rotating a rod 28 and providing a squirming massage function. In one embodiment, the squirming massage function is generated by rotation of rod 28 in either a clockwise or counter-clockwise direction for imparting a squirming action to a hollow prosthetic member 17 that encases the squirming massage actuator 14.

Figure 3:
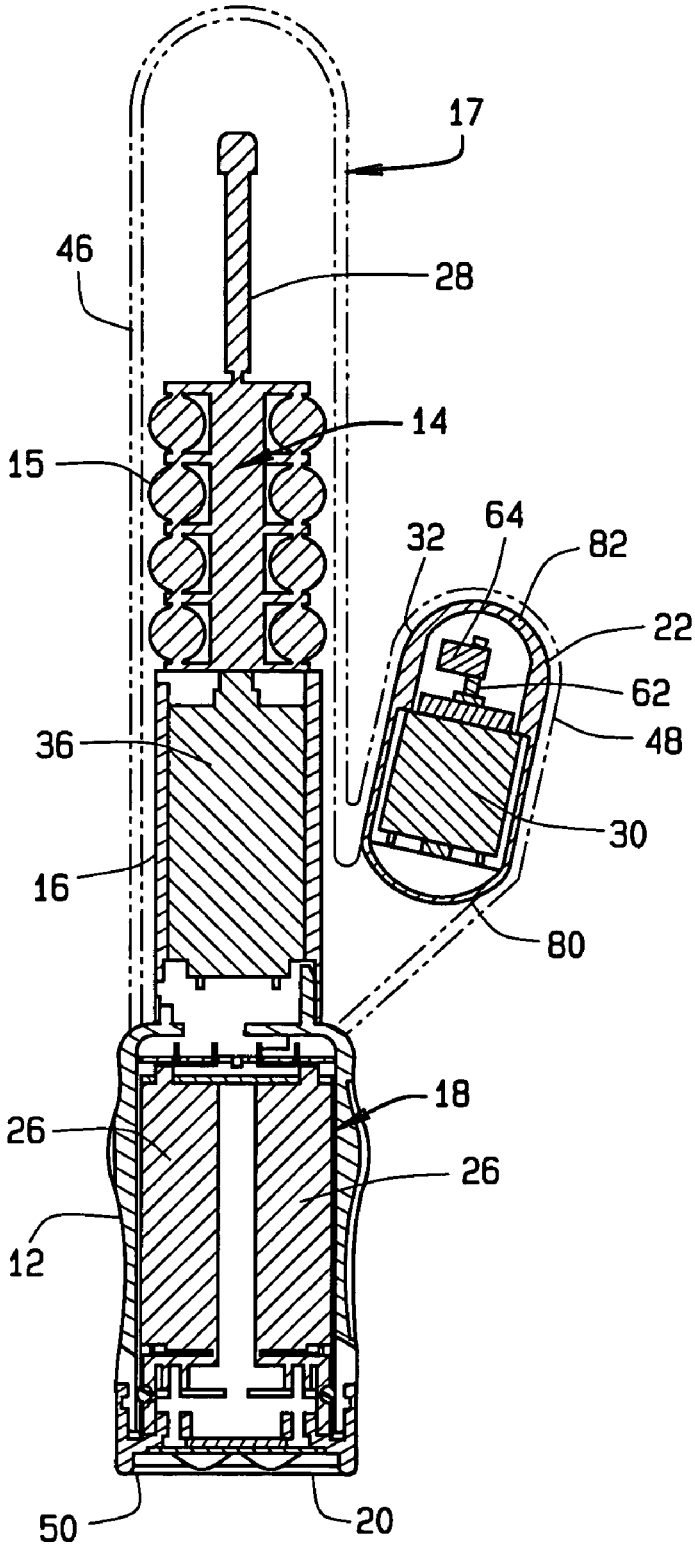
FIG. 3 is a cross-sectional view of the massage apparatus engaged to a prosthetic outer sleeve.

As show in FIG. 3, the control panel 20 is in operative association with vibration massage actuator 22, which is encased in a shell 32 defined by a lower casing 80 engaged to an upper casing 82. The vibration massage actuator 22 comprises a motor 30 that rotates a rod 62 having an eccentric mass 64 mounted thereon. When the motor 30 is operated, rotation of the eccentric mass 64 by rod 62 generates a vibration massage function that imparts a vibrating action to shell 32. A wire 104 (FIG. 2) is operatively connected between the squirming massage actuator 14, vibration massage actuator 22, removable battery compartment 18 and control panel 20 in order to provide a means of powering and controlling the various operations of massage apparatus 10. As further shown, cylinder 16 defines an access hole for wire 104 that is in operative association between the control panel 20 and the vibration massage actuator 22 encased in shell 32.

As further shown, the main body 12 includes a pair of rubber skins 60 disposed thereon for providing an ergonomic gripping surface for the user when handling massage apparatus 10. In one embodiment, the rubber skins 60 have various heart shaped configurations, although other suitable shapes are felt to fall within the scope of the present invention. The shape and configuration of the main body 12 in conjunction with the rubber skins 60 make the massage apparatus 10 particularly adapted for use in wet environments such that the user may easily manipulate the massage apparatus 10.

As noted above, the massage apparatus 10 may be engaged to a hollow prosthetic member 17 for imparting the squirming action and/or vibrating action to the user. The hollow prosthetic member 17 is made from a resilient material that defines a main sleeve 46 in communication with a secondary sleeve 48. The main sleeve 46 of the hollow prosthetic member 17 is adapted to receive the squirming massage actuator 14, while secondary sleeve 48 is adapted to receive the shell 32 containing the vibration massage actuator 22 such that the squirming and vibration actions of the massage apparatus 10 are provided substantially along the main sleeve 46 and auxiliary sleeve 48 of the hollow prosthetic member 17, respectively.

The removable battery compartment 18 provides a means for powering and controlling the massage apparatus 10 when engaged to the main body 12. As shown, the removable battery compartment 18 comprises a body 38 that defines a plurality of chambers 68 adapted to receive a respective battery 26 therein and a terminal end member 50 operatively engaged to the control panel 20. The terminal end member 50 is located along the distal end of body 38 and defines a chamber 69 adapted to receive the various components of the control panel 20. In one embodiment, four batteries 26 are disposed inside removable battery compartment 18 for supplying power to the massage apparatus 10. A pair of spring elements 94, 96 and springs 86, 88 engage each battery 26 inside compartment 68. In addition, a pair of printed circuit boards 74, 76 are in operative association with the control panel 20 for operating the various components of massage apparatus 10 and are secured within the main body 12 using screws 90 and shrapnel pieces 78.

As noted above, the terminal end member 50 includes control panel 20 in operative association with printed circuit boards 74, 76 and comprises a body 51 having a switch arrangement 56 consisting of buttons A, B, C and D (FIG. 4) that operate one or more massage actuators of massage apparatus 10. A waterproof faceplate 54 covers the switch arrangement 56 such that the waterproof surface prevents water from entering the control panel 20. In addition, a pair of sealing elements 98, 100, such as O-ring seals, are provided between the body 51 and the removable battery compartment 18 in order to maintain a waterproof seal when the removable battery compartment 18 is operatively engaged to the main body 12.

Referring back to FIG. 4, the control panel 20 permits operation of the various components of the massage apparatus 10 once the removable battery compartment 18 is operatively engaged with the main body 12. In particular, button A turns the vibration massage actuator 22 ON or OFF such that turning the actuator 22 ON allows the shell 32 to vibrate, while turning button A OFF terminates the vibration of shell 32 imparted by actuator 22. Once button A is actuated and the vibration massage actuator 22 is ON, button B may be actuated which controls the speed of vibration of the actuator 22 from a low speed mode to HIGH speed mode or vice versa every time button B is actuated. Button C is used to turn the squirming massage actuator 14 ON or OFF when actuated by the user such that the rod 28 is made to rotate and provide a squirming massage action, while actuation of button D changes the direction of rotation of rod 28 from clockwise to counter-clockwise or vice-versa once squirming massage actuator 14 has been activated by actuation of button C. However, the present invention contemplates that buttons A-D may be used to perform the same functions using different button arrangements to accomplish these functions. In addition, all four buttons A, B, C and D may be operated to actuate both the squirming massage actuator 14 for rotating rod 28 and vibration massage actuator 22 for vibrating shell 32 simultaneously.

It should be understood from the foregoing that, while particular embodiments have been illustrated and described, various modifications can be made thereto without departing from the spirit and scope of the invention as will be apparent to those skilled in the art. Such changes and modifications are within the scope and teaching of this invention as defined in the claims appended hereto.

What is claimed is:

1. A massage apparatus comprising:

a main body including a portion having a gripping surface configured to be held by a user;

a first actuator capable of generating a squirming massage function;

a second actuator capable of generating a vibrating massage function;

a removable battery compartment adapted to be operatively engaged to said main body;

a terminal end member on a terminal end of said removable battery compartment;

a control panel including a plurality of buttons to control operation of a motor and located on said terminal end member so that said user does not contact said control panel or said buttons when gripping said portion of said main body during manipulation of said main body; and a prosthetic member encasing said first and second actuators, wherein said first actuator is a squirming massage actuator having said motor in operative engagement with a gear case assembly for rotating a rod to provide a squirming action to said prosthetic member.

2. The massage apparatus according to claim 1, wherein said control panel includes a waterproof faceplate.

3. The massage apparatus according to claim 1, wherein said removable battery compartment further comprises at least one sealing member that forms a water-tight seal with said main body when said removable battery compartment is operatively engaged to said main body.

4. The massage apparatus according to claim 1, wherein said control panel controls a rotational movement of said squirming massage actuator.

5. The massage apparatus of claim 1, wherein said control panel is capable of being separated from at least one of said main body, said first actuator and said second actuator.

6. The massage apparatus of claim 5, wherein said control panel is capable of being separated from at least one of said main body, said first actuator and said second actuator by removing said removable battery compartment from said main body.

7. A massage apparatus comprising:

a main body operatively associated with at least one massage actuator and including a portion configured to be gripped by a user during manipulation of said apparatus;

a removable battery compartment adapted to be operatively engaged to said main body, said removable battery compartment including a control panel for controlling operation of said at least one massage actuator when said removable battery compartment is operatively engaged to said main body, said control panel located on a terminal end of said battery compartment so that said user does not contact said control panel when gripping said portion of said main body and during manipulation of said apparatus;

a prosthetic member, wherein said massage actuator comprises a squirming massage actuator having a motor in operative engagement with a gear case assembly within said main body for rotating a rod to provide a squirming action to said prosthetic member, wherein said control panel includes at least one indentation and at least one pushbutton disposed beneath said at least one indentation, wherein at least one pushbutton operatively controls operation of said at least one massage actuator; and a second massage actuator, wherein said control panel further includes a third pushbutton disposed in a third indentation, said third pushbutton being adapted to adjust a vibrating action produced by said second massage actuator from a "low" mode to a "high" mode wherein said control panel further includes a second pushbutton disposed beneath a second indentation, said second pushbutton being adapted to change a rotational movement of said at least one massage actuator from a clockwise motion to a counterclockwise motion and vice-versa.

8. The massage apparatus of claim 7, wherein said control panel is capable of being separated from at least one of said main body and said actuator.

9. The massage apparatus of claim 8, wherein said control panel is capable of being separated from at least one of said main body and said actuator by removing said removable battery compartment from said main body.

10. A waterproof massage apparatus comprising:

a main body having at least one massage actuator, said main body being adapted to be operatively engaged to a removable battery compartment;

a first massage actuator comprising a squirming massage actuator having a motor in operative engagement with a gear case assembly within said main body for rotating a first rod to provide a squirming massage function to a prosthetic member;

a second massage actuator comprising a vibration massage actuator having a second motor for rotating a second rod connected to an eccentric mass to provide a vibrating massage function to said prosthetic member; and a removable battery compartment including at least one sealing element for providing a water-tight seal between said main body and said removable battery compartment when said removable battery compartment is operatively engaged to said main body, said removable battery compartment having a control panel for controlling operation of at least one of said first and second massage actuators.

11. The waterproof massage apparatus according to claim 10, wherein said control panel is made operational when said removable battery compartment is engaged to said main body.

12. The waterproof massage apparatus according to claim 10, wherein said control panel becomes operatively associated with at least one of said first and second massage actuators when said removable battery compartment is engaged to said main body.

* * * * *